US006508676B1

(12) United States Patent
Xu

(10) Patent No.: US 6,508,676 B1
(45) Date of Patent: Jan. 21, 2003

(54) ELECTRICAL CONNECTOR WITH TERMINAL INSERT

(75) Inventor: Xiang Xu, Kunsan (CH)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 10/006,884

(22) Filed: Dec. 4, 2001

(51) Int. Cl.[7] ..... H01R 24/00
(52) U.S. Cl. ..... 439/660; 439/701
(58) Field of Search ..... 439/79, 701, 660

(56) References Cited

U.S. PATENT DOCUMENTS 5,643,013 A * 7/1997 Weidler et al. ..... 439/660
5,971,809 A * 10/1999 Ho ..... 439/660
5,980,325 A * 11/1999 Horchler ..... 439/701
6,139,372 A * 10/2000 Yang ..... 439/701

* cited by examiner

*Primary Examiner*—Gary Paumen
(74) *Attorney, Agent, or Firm*—Wei Te Chung

(57) ABSTRACT

A SCSI connector (100) includes an insulating housing (1), a terminal insert (2) with a plurality of terminals (21) retained therein, a shield (3) enclosing a front portion (11) of the housing, a pair of retaining devices (4), and a spacer (5) for orientating the terminals. The terminal insert has an insulating body (20) including a main portion (22) and a forwardly extending tongue portion (23). The main portion tapers in a back-to-front direction and the tongue portion has a constant thickness. The insulating housing defines a receiving opening (12) corresponding to the configuration of the main portion for receiving the terminal insert therein.

1 Claim, 4 Drawing Sheets

ELECTRICAL CONNECTOR WITH TERMINAL INSERT

BACKGROUND OF THE INVENTION

1. Field of the Invention

The present invention relates to a Small Computer Systems Interface (SCSI) connector, and particularly to a SCSI connector having a terminal insert.

2. Description of Prior Art

A Small Computer Systems Interface (SCSI) connector mounted on a printed circuit board includes an insulating housing and a plurality of conductive contacts received in the housing. One common approach for accommodating the conductive contacts in the housing is to apply a terminal insert wherein the contacts are insert molded in an insulating body thereof which in turn is inserted into a receiving opening of the housing. Such an insulating body of the terminal insert has a constant thickness, which cannot ensure a reliable engagement with the receiving opening of the housing, thereby resulting in an improper engagement between the contacts of the terminal insert and terminals of a mating connector. Another approach involves an otherwise terminal insert integrating with the housing. However, this kind of integral terminal insert not only complicates the manufacturing process but also increases the manufacturing cost.

Hence, an improved SCSI connector is required to overcome the disadvantages of the prior art.

BRIEF SUMMARY OF THE INVENTION

The object of the present invention is to provide a SCSI connector with a terminal insert which can be precisely and securely received in an insulating housing thereof.

A SCSI connector in accordance with the present invention comprises an insulating housing, a terminal insert including an insulating body and a plurality of terminals retained in the insulating body, a shield enclosing the housing, a pair of retaining devices attached to the housing, and a spacer through which the terminals are oriented to through-holes of a printed circuit board. The insulating body of the terminal insert is received in a corresponding receiving opening of the housing, and has a main portion and a tongue portion extending forwards from the main portion. The main portion tapers in a back-to-front direction, whereby the thickness h2 of a front end thereof is smaller than the thickness h1 of a rear end thereof. The wedge-shaped main portion terminal insert can be precisely and securely retained in the receiving opening of the housing, compared with the prior art.

Other objects, advantages and novel features of the invention will become more apparent from the following detailed description of the present embodiment when taken in conjunction with the accompanying drawings.

DETAILED DESCRIPTION OF THE INVENTION

Figure 1:
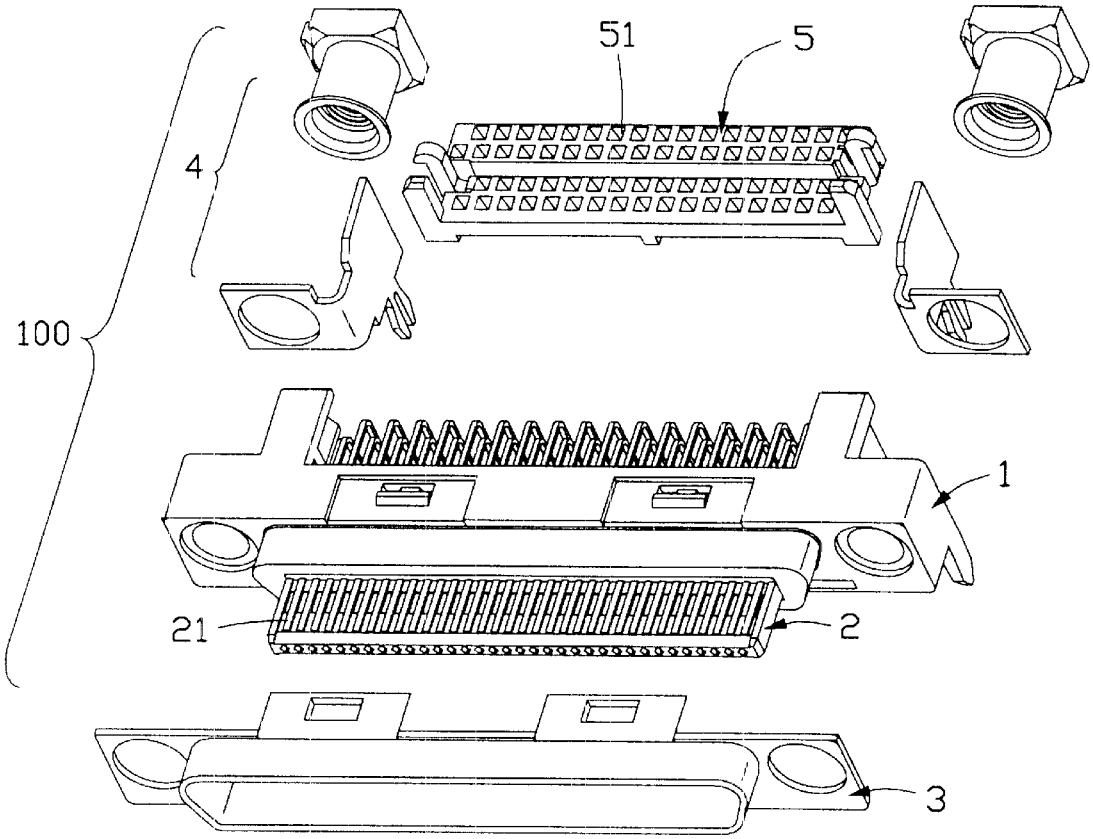
FIG. 1 is an exploded, perspective view of a SCSI connector in accordance with the present invention.

Referring to FIG. 1, a SCSI connector 100 for being mounted on a printed circuit board (not shown) in accordance with the present invention comprises an insulating housing 1, a terminal insert 2 received in the insulating housing 1, a shield 3 for enclosing the insulating housing 1, and a pair of retaining devices 4 for being attached to the insulating housing 1, and a spacer 5 through which terminals 21 of the terminal insert 2 are oriented to through-holes of the printed circuit board and soldered therewith.

Figure 2:
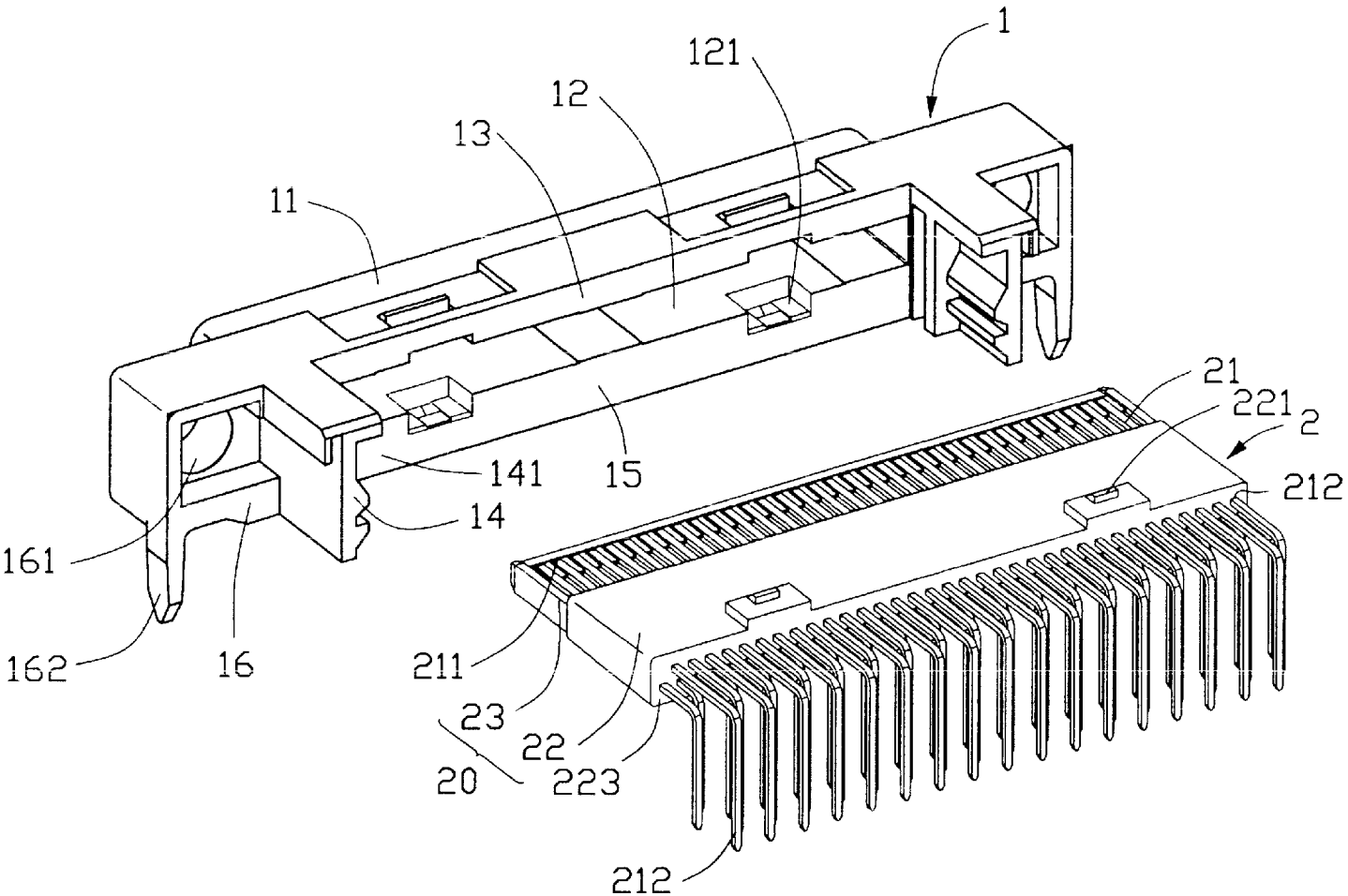
FIG. 2 is an exploded, perspective view of a housing and a terminal insert of the SCSI connector.
Figure 3:
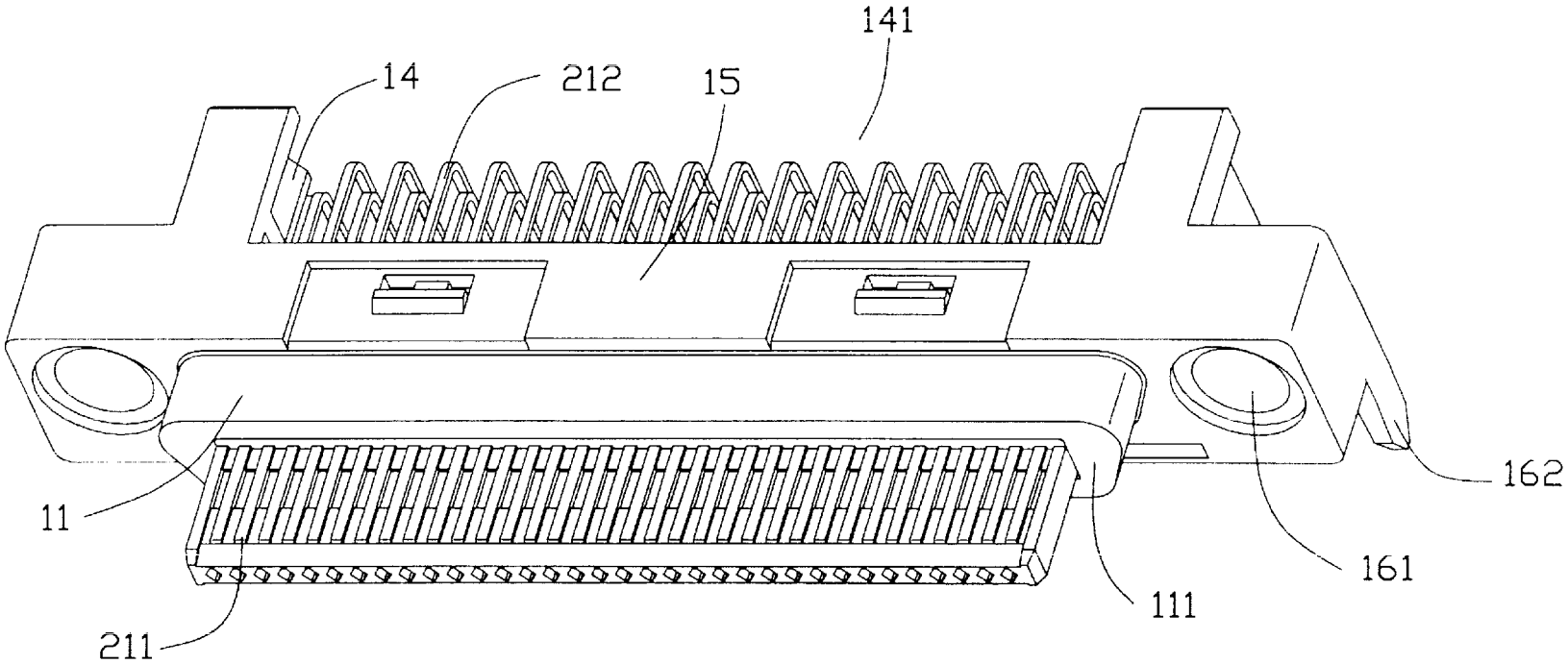
FIG. 3 is an assembled, perspective view of the housing and the terminal insert shown in FIG. 2 from an opposite direction.

Referring to FIGS. 2 and 3, the insulating housing 1 comprises a back portion 15 and a front portion 11 extending forwardly from the back portion 15. A receiving opening 12 is defined through the back portion 15 and the front portion 11 for receiving the terminal insert 2. The insulating housing 1 further has a pair of retaining arms 16 projecting from opposite ends of the back portion 15, each of which defines a retaining hole 161 for receiving the retaining device 4 and a retaining foot 162 for inserting into a corresponding hole of the printed circuit board to secure the housing 1 thereon. A pair of opposed walls 14 extend from a back face 13 of the back portion 15 and define a receiving space 141 therebetween in communication with the receiving opening 12. Two pairs of cutouts 121 are defined in the back face 13 of the back portion 15 and communicating with the receiving opening 12.

Figure 4:
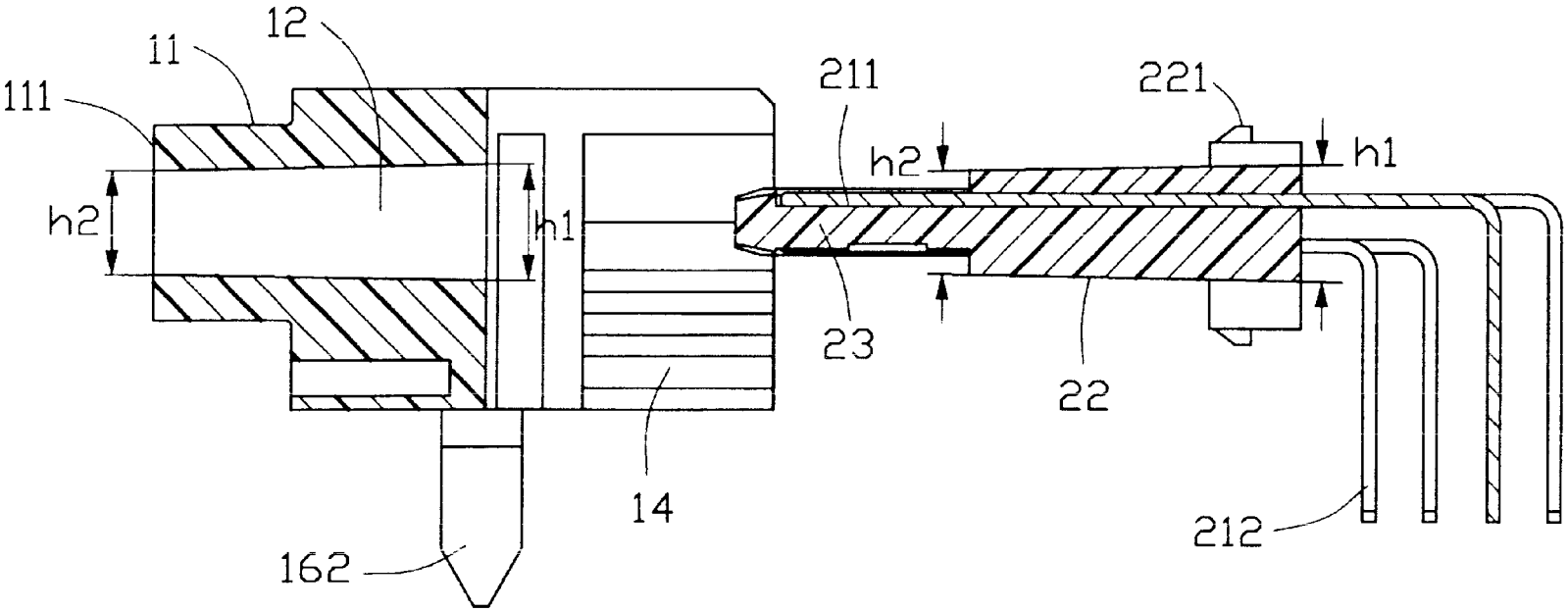
FIG. 4 is a cross-sectional view of the housing and the terminal insert shown in FIG. 2.

The terminal insert 2 has an insulating body 20 including a main portion 22 and a tongue portion 23 forwardly extending from the main portion 22. Referring to FIG. 4, a cross-sectional view of the insulating housing 1 and the terminal insert 2 is shown. It is easy to see that the main portion 22 of the terminal insert 2 tapers in a back-to-front direction, whereby the thickness h1 of a rear end of the main portion 22 is larger than the thickness h2 of a front end of the main portion 22. The tongue portion 23 has a thickness smaller than the thickness h2. The receiving opening 12 of the insulating housing 1 is defined correspondingly to the configuration of the main portion 22 of the terminal insert 2 for precisely receiving the main portion 22 therein. Two pairs of protrusions 221 are further formed on opposite sides of the main portion 22 for respectively engaging with the cutouts 121 of the housing 1 to securely fix the terminal insert 2 in the insulating housing 1.

The terminals 21 of the terminal insert 2 comprise contacting portions 211 retained on a topside of the tongue portion 23, intermediate portions (not shown) received in the main portion 22, and soldering portions 212 projecting from a rear face 223 of the terminal insert 2 and extending downwardly towards the printed circuit board for soldering with corresponding through-holes thereof.

In assembly, firstly, the terminal insert 2 is inserted into the receiving opening 12 of the insulating housing 1 through the receiving space 141 with the tongue portion 23 extending beyond a front face 111 of the insulating housing 1. Then, the shield 3 is attached to the insulating housing 1, enclosing the front portion 11 and engaged with the back portion 15. Finally, the retaining devices 4 are fixed to the retaining arms 16 of the housing 1 for assembling the shield 3 and the housing 1 together and for guiding purpose. The soldering portions 212 of the terminals 21 are inserted in and soldered with the corresponding through-holes of the printed circuit board, which are oriented by a plurality of channels 51 defined in the spacer 5.

Compared with the prior art, the engagement between the wedge-shaped opening 12 of the housing 1 and the wedge-shaped main portion 22 of the terminal insert 2 ensures a secure and precise engagement between the terminal insert 2 and the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted on a printed circuit board, comprising:

an insulating housing defining a receiving opening; and a terminal insert comprising an insulating body and a plurality of terminals retained in the insulating body, the insulating body having a main portion tapering in a back-to-front direction and a tongue portion forwardly extending from the main portion;

wherein the receiving opening of the insulating housing is correspondingly tapered to receive the main portion therein;

wherein the tongue portion of the terminal insert has a thickness smaller than the main portion, wherein the insulating housing defines a plurality of cutouts in a back face thereof, and the terminal insert has a plurality of protrusions protruding from opposite sides thereof and received correspondingly in the plurality of cutouts;

wherein the insulating housing comprises a back portion and a front portion extending forwardly from the back portion, and the tongue portion of the terminal insert extends beyond the front portion;

further comprising a metal shield enclosing the front portion of the insulating housing;

further comprising a pair of retaining devices, and wherein the insulating housing has a pair of retaining arms formed on opposite ends thereof for respectively engaging with the pair of retaining devices;

wherein each of the plurality of terminals comprises a contact portion exposed on a topside of the tongue portion of the terminal insert, and a soldering portion projecting from a back face of the main portion of the terminal insert and extending downwardly for soldering with a printed circuit board.

* * * * *